US006590555B2

(12) United States Patent
Su et al.

(10) Patent No.: US 6,590,555 B2
(45) Date of Patent: Jul. 8, 2003

(54) LIQUID CRYSTAL DISPLAY PANEL DRIVING CIRCUIT AND LIQUID CRYSTAL DISPLAY

(75) Inventors: Feng-Cheng Su, Hsinchu (TW); Chun-Chin Tseng, Changhua Hsien (TW)

(73) Assignee: Au Optronics Corp., Hsin-Chu (TW)

( * ) Notice: Subject to any disclaimer, the term of this patent is extended or adjusted under 35 U.S.C. 154(b) by 215 days.

(21) Appl. No.: 09/796,350

(22) Filed: Mar. 2, 2001

(65) Prior Publication Data

US 2002/0050971 A1 May 2, 2002

(30) Foreign Application Priority Data

Oct. 31, 2000 (TW) ..... 89122880 A

(51) Int. Cl.[7] ..... G09G 3/36

(52) U.S. Cl. ..... 345/92; 345/87; 345/93; 345/94; 345/96; 345/101; 349/72

(58) Field of Search ..... 345/92, 93, 94, 345/96, 101, 87; 349/72

(56) References Cited

U.S. PATENT DOCUMENTS 5,754,154 A * 5/1998 Katakura et al. ..... 345/97
5,852,430 A * 12/1998 Endo ..... 345/101
6,075,511 A * 6/2000 Iwasaki et al. ..... 345/101
6,313,818 B1 * 11/2001 Kondo et al. ..... 345/96

* cited by examiner

*Primary Examiner*—Richard Hjerpe
*Assistant Examiner*—Jean Lesperance
(74) *Attorney, Agent, or Firm*—Darby & Darby

(57) ABSTRACT

A LCD panel driving circuit, comprising a gate driver for outputting a scan signal, a data driver for outputting a video signal, a switch circuit, and a temperature sensor. The temperature sensor detects the operating temperature of the LCD panel to determine whether or not the detected temperature is over a switch temperature and produces a selection signal. The switch selects a 1-line dot inversion control signal or a 2-line dot inversion control signal according to the selection signal and outputs a polar control signal, thereby controlling the selection of the outputted video signal polarity.

7 Claims, 7 Drawing Sheets

LIQUID CRYSTAL DISPLAY PANEL DRIVING CIRCUIT AND LIQUID CRYSTAL DISPLAY

BACKGROUND OF THE INVENTION

1. Field of the Invention

The invention relates to a liquid crystal display (LCD) panel driving circuit and liquid crystal display, particularly to the 1-line and 2-line dot inversion driving mode of the LCD panel data driver, providing a method capable of eliminating the frame flickers in the prior art and/or the odd/even scan line brightness unevenness of the LCD panel driver circuit, thereby improving the frame quality.

2. Description of the Related Art

FIG. 1 is a schematic diagram of a prior art liquid crystal display panel (hereinafter, referred to as a "LCD panel") and the peripheral driving circuit thereof. As shown in the figure, a LCD panel is formed by interlacing data electrodes (represented on D1, D2, D3, . . . , Dm) and gate electrodes (represented on G1, G2, G3, . . . , Gm), each of interlacing data electrodes and gate electrodes is used to control a display unit. For example, using the interlacing data electrode D1 and gate electrode G1 controls the display unit 200. The equivalent circuit of each display unit comprises thin film transistors (TFT) (Q11–Q1*m*, Q21–Q2*m*, . . . , Qn1–Qnm) and storage capacitors (C11–C1*m*, C21–C2*m*, . . . , Cn1–Cnm). The gate and drain of TFTs are respectively connected to gate electrodes (G1–Gn) and data electrodes (D1–Dm). Such a connection can turn on/off all TFTs on the same line (i.e. positioned on the same scan line) using a scan signal of gate electrodes (G1–Gn), thereby controlling the video signal of data electrodes to be written into the corresponding display unit. It is noted that a display unit only controls a single pixel brightness on the LCD panel. Accordingly, each display unit responds to a single pixel on a mono-color LCD while each display unit responds to a single subpixel on a color LCD. The subpixel can be red (represented by "R"), blue (represented by "G"), or green (represented by "G"). In other words, a single pixel is formed of a RGB (three display units) combination.

In addition, FIG. 1 also shows a part of the driving circuit of the LCD panel 1. Gate driver 10 outputs the scan signals (or referred to as a scan pulse) of each of the gate electrodes G1, G2, . . . , Gn according to a predetermined sequence. When a scan signal is carried on one gate electrode, the TFTs within all display units on the same row or the same scan line are turned on while the TFTs within all display units on other rows or other scan lines are in a state to be turned off. When a scan line is selected, data driver 20 outputs a video signal (gray value) to the m display units of the respective row through data electrodes D1, D2, . . . , Dm according to the image data to be displayed. After gate driver 10 scans n rows continuously, the display of a single frame is completed. Thus, repeated scans of each scan line can achieve the purpose of continuously displaying the image. As shown in FIG. 1, signal CPV indicates the clock of gate driver 10, signal CRT indicates the scan control signal received by gate driver 10, signal LD indicates a data latch signal of data driver 20, and signal DATA indicates the image signal received by data driver 20.

Typically, a video signal, which is transferred by the data electrodes D1, D2, . . . , Dm, is divided into a positive video signal and a negative video signal based on the relationship with the common electrode voltage $V_{COM}$. The positive video signal indicates the signal having a voltage level higher than the voltage $V_{COM}$, and based on the gray value represented, the actually produced potential of the signal ranges between voltages Vp1 and Vp2. In general, the gray value closer to the common electrode voltage $V_{COM}$ is lower. On the other hand, the negative video signal indicates the signal having a voltage level lower than the voltage $V_{COM}$, and based on the gray value represented, the actually produced potential of the signal ranges between voltages Vn1 and Vn2. Also, the gray value closer to the common electrode voltage $V_{COM}$ is lower. When a gray value is represented, whether in a positive video signal or in a negative video signal, the display effect generally is the same. In order to prevent the liquid crystal molecule from continuously receiving a single-polar bias voltage so as to reduce the liquid crystal molecular life, a display unit respectively receives positive and negative polar video signals corresponding to odd and even frames.

The disposition of the different polar video signal in each display unit can be divided into four driving types: frame inversion, line inversion, column inversion, and dot inversion. In frame inversion driving mode, the polarity of the video signal is the same on the same frame but the opposite on its adjacent frames. In line or column inversion driving mode, the same line or column on the same frame has the same polarity of the video signal but the opposite polarity to its adjacent lines or columns. In dot inversion driving mode, the polarity of the video signal on the same frame is presented in an interlaced form, which will be described in detail later.

In the actual practice using dot inversion, it can be further divided into a 1-line dot inversion and a 2-line dot inversion, described as follows.

FIG. 2 is a schematic diagram of the polarity of the video signal received by display units of a color LCD panel in a prior 1-line dot inversion driving mode. In FIG. 2, a coordinate represents a single pixel, e.g. (i,j), (i+1,j), (i,j+1), (i+1,j+1) . . . , the single pixel further including three corresponding subpixels, i.e. red (R), green (G), and blue (B) subpixels, wherein a subpixel corresponds to a single display unit of FIG. 1. In the 1-line dot inversion driving mode, the video signal polarity of a display unit on the same frame is the opposite to that of its adjacent units, including at the up, down, left, and right positions. The subpixels positioned on the oblique areas of FIG. 2 (for example, (i,j,R), (i,j,B), (i+1,j,G), (i+2,j,R), (i+2,j,B), . . . , and so on) and the other subpixels (for example, (i,j,G), (i+1,j,R), (i+1,j,B), (i+2,j,G), . . . , and so on) on the same frame receive the opposite polarities. For example, the subpixels positioned on the oblique have the positive polarity of the video signal while the other subpixels have the negative polarity. The inverse operation has the same feature as the above.

Although the slightly display difference between the positive and negative polarity of the video signals exists, the full display effect is not obviously different from the 1-line dot inversion driving mode when viewing a stationary frame. An example of FIG. 2, it is assumed that this area is blue (B) color, i.e. light on B, and light off R (red) and G (green). In pixels (i,j), (i,j+2), (i+1,j+1), (i+1,j+3), (i+2,j), (i+2,j+2), . . . of the Nth frame, the B subpixels receive positive polarity video signal, while in pixels (i,j+1), (i,j+3), (i+1,j), (i+1,j+2), . . . of the Nth frame, the B subpixels receive a negative polarity video signal. However, the polarity of the pixels of the N+1th frame is opposite to that of the Nth frame. Either the pixels on the Nth frame or the pixels on the N+1th frame have almost the same display effect, compared to both frames. However, an obvious display difference may happen on some specific frame, for example, the shut-down frame with the Microsoft Windows Operating System (MS OS).

For the shut-down frame with the MS OS, only half pixels of a scan line are selected to be displayed, and pixels selected from two adjacent scan lines are different to each other scan line. For an example of FIG. 2, the shutdown frame with Windows OS displays (i,j), (i,j+2), (i+1,j+1), (i+1,j+3), (i+2,j), (i+2,j+2), (i+3,j+1), (i+3,j+3), (i+4,j), (i+4, j+2), (i+5,j+1), (i+5,j+3). When the 1-line dot inversion is used, the pixels are presented to all positive video signals on a current frame and to all negative video signals on the next frame. Thus, the display difference can not be neutralized due to the polarities of the two sequential frames, thereby causing a flicker effect on the frame.

FIG. 4 is a schematic diagram of the video signal polarity received from each display unit of a color LCD panel in a prior 2-line dot inversion driving mode. The 2-line dot inversion driving mode is different from the 1-line dot inversions in that the inversion is performed every two lines, i.e. a scan unit includes two subsequent lines. For example, the $i^{th}$ and $(i+1)^{th}$ lines are a unit of inversion or scan, otherwise, they are the same, including the inversion processes. Likely, in FIG. 4, the subpixels of all slashed squares in the same frame have the same polarity and the subpixels of the rest in the same frame have the same polarity in the opposite of the slash squares.

The 2-line dot inversion driving mode using in a shut-down frame with the Windows OS does not have the disadvantages the same as in the 1-line dot inversion driving mode. As shown in FIG. 4, the pixel numbers of the slash squares on the shutdown frame with the Windows OS are generally the same as that of the rest on the same frame, thereby neutralizing the display difference. Therefore, the frame will not have a flicker effect.

However, a problem of the 2-line dot inversion driving mode is the uneven brightness between odd and even lines on a frame. FIG. 5 shows the timing diagram of the signals of a color LCD panel and driving circuit thereof in the prior 2-line dot inversion driving mode. In FIG. 5, signal DE represents the data enable. When DE=1, it represents in the currently effective data. Signal POL represents the polarity control signal of the data driver 20. Signal LD represents the latch of the data driver 20. When the signal LD is on the falling edge, it represents that the data is sent out from the data driver 20. Signal D1, Vc11, Vc21 represent the voltages of data electrode D1, storage capacitor C11, and storage capacitor C21, respectively. The storage capacitor C11 and the storage capacitor C21 are separately positioned on two adjacent scan lines, which have the same polarity in the 2-line dot inversion driving mode.

As shown in FIG. 5, when driving the display unit of the storage capacitor C11, a rising time Tr is required to drive the display unit to a positive polarity (due to the negative polarity on the previous frame). The actual charging time is only T3. When driving the display unit of the storage capacitor C21 (next one scan line), the actual charging time is T4 without the rising time Tr because the current state is on the positive polarity due to the previous scan line. Other display units on the same scan line or the other scan line of the two same polarity scan lines are the same as mentioned above. Therefore, as the scan lines are not charged sufficient, the different charging between adjacent odd and even scan lines cause different brightness, which is referred to as a problem of the odd and even scan line brightness unevenness. Particularly, this condition evidently appears on the lower temperature operation.

On the other hand, the 1-line dot inversion does not show such a problem. FIG. 3 shows a timing diagram of the signals of a color LCD panel and driving circuit thereof in the prior 1-line dot inversion driving mode. As shown in FIG. 3, the display unit, whether of the capacitor C11 or of the capacitor C21, needs a rising time or a falling time, thus the charging time T1 is the same as the charging time T2. This makes the brightness of the display uniform even though the charge is insufficient.

Hence, whether the 1-line dot inversion driving mode or the 2-line dot inversion driving mode has the respective problem.

SUMMARY OF THE INVENTION

Accordingly, an object of the invention is to provide a liquid crystal display (LCD) panel driving circuit including the LCD, and the method of using the driving circuit to improve the frame quality. A LCD panel is controlled by the LCD panel driving circuit, which includes a plurality of display units and a plurality of data electrodes and gate electrodes, respectively, corresponding to the plurality of display units. The driving circuit includes gate drivers to output the scan signal to the gate electrode and data drivers to output the video signal to the data electrode. The data driver determines the video signal polarity to be outputted according to a polar control signal. In addition, the driving circuit also includes a switch circuit and a temperature sensor. The temperature sensor detects whether or not the temperature, such as an operating temperature, corresponding to the LCD panel, is over a switch temperature (for example, from 0° C. to 25° C., preferably from 10° C. to 18° C., depending on the characteristic of the used film transistor and the material of the LCD), thereby producing a selection signal. The switch circuit selects one of the first polar control signals and a second polar control signal as the output polar control signal according to the selection signal. The first polar control signal is used to control the video signal as the 1-line dot inversion driving mode, and the second polar control signal is used to control the video signal as the 2-line dot inversion driving mode. Thus, the 1-line dot inversion driving mode is used at low temperature to avoid the odd and even scan brightness unevenness, and the 2-line dot inversion driving mode is used at high temperature to avoid the specific frame flickers, thereby improving the display frame quality.

BRIEF DESCRIPTION OF THE DRAWINGS

The aforementioned objects, features and advantages of this invention will become apparent by referring to the following detailed description of a preferred embodiment with reference to the accompanying drawings, wherein.

DETAILED DESCRIPTION OF THE INVENTION

The LCD panel driving circuit includes the LCD thereof and the method of improving the frame quality using the driving circuit. The method of improving the frame quality selects one of a 1-line dot inversion driving mode and a 2=line dot inversion driving mode according to the operation conditions required, thereby having a preferable display quality.

In the embodiment, the temperature control is used to change the video signal driving mode. That is, at a normal operating temperature (i.e. room temperature), the 2-line dot inversion driving mode is used because insufficient charge does not occur at room temperature in general. Thus, the odd and even scan line brightness unevenness does not show up, and the specific frames (like the Windows shutdown frame) do not have the flicker effect. When the temperature reduces to a certain level, the 1-line dot inversion driving mode is used. Under this low temperature, the flickers from the difference between the positive and negative polarities is slight, thereby avoiding the odd and even scan line brightness unevenness in normal operations. This is described in detail with reference to the drawings as follows.

Figure 6:
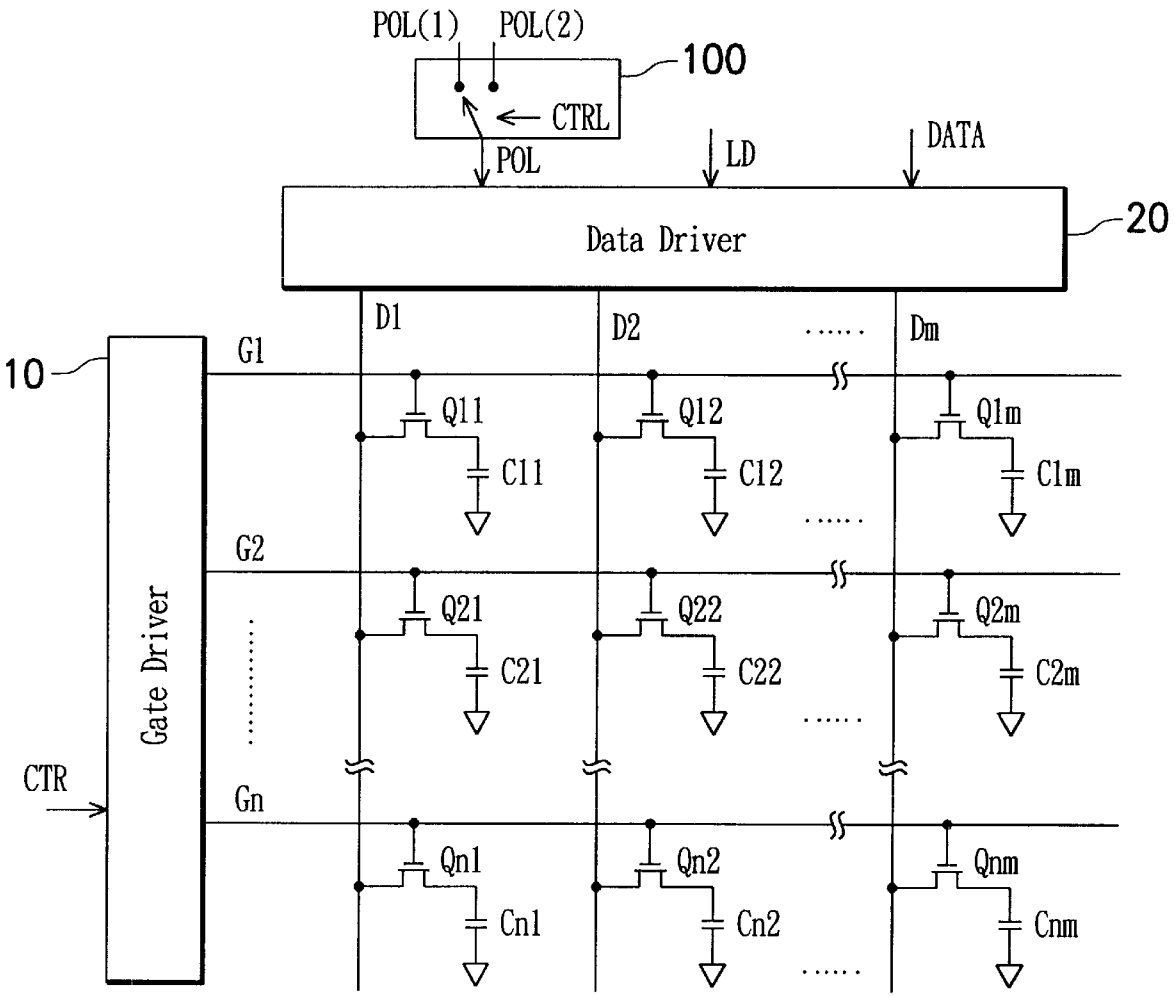
FIG. 6 is a schematic diagram of a color LCD panel and driving circuit thereof of the invention.

Refer to FIG. 6, a schematic diagram of a color LCD panel and driving circuit thereof of the invention.

In FIG. 6, the driving circuit includes a gate driver 10, a data driver 20 and an added switch circuit 100.

Figure 1:
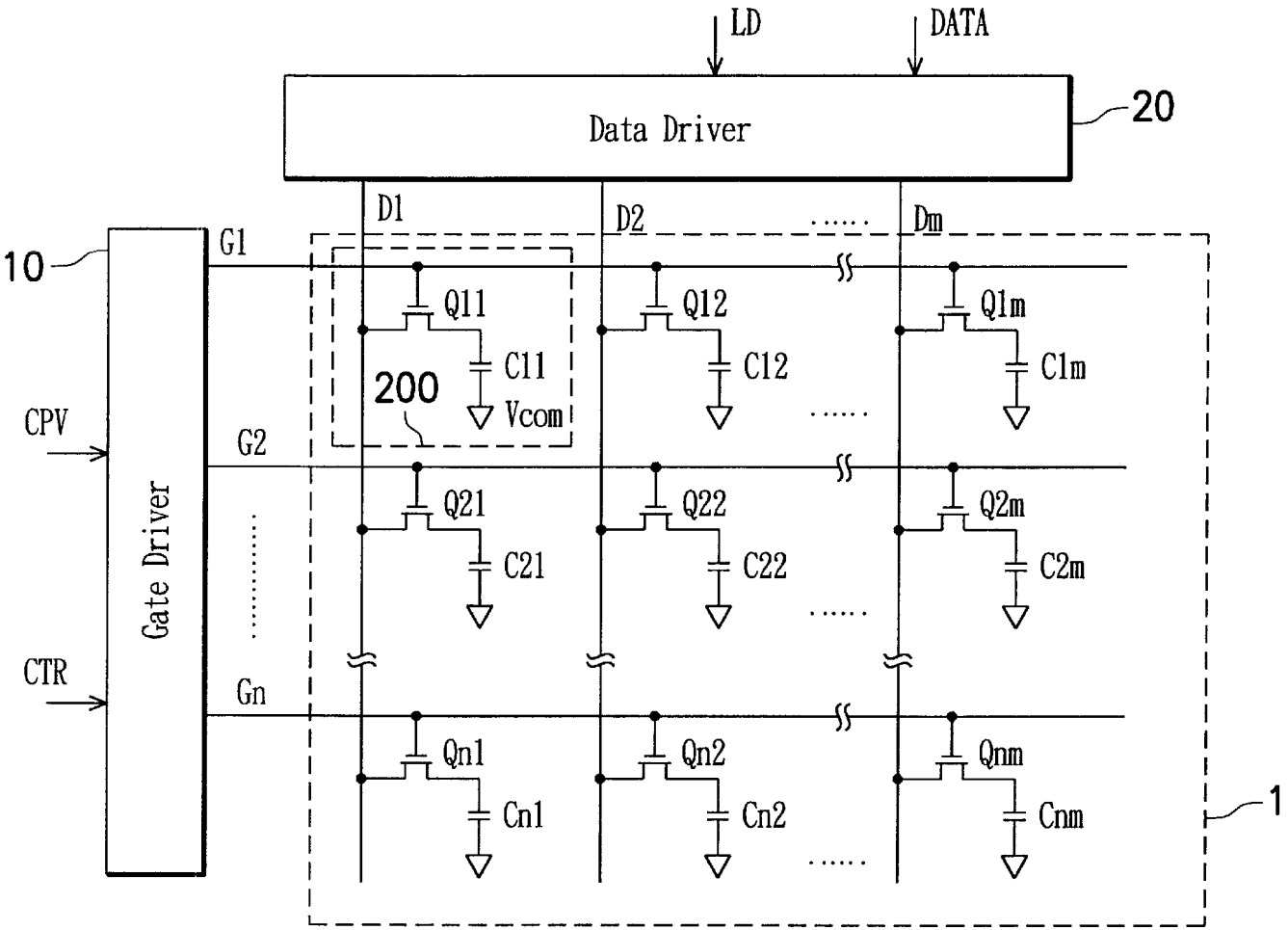
FIG. 1 (PRIOR ART)
FIG. 1 is a schematic diagram showing a prior art liquid crystal display panel and the peripheral driving circuit thereof.
Figure 2:
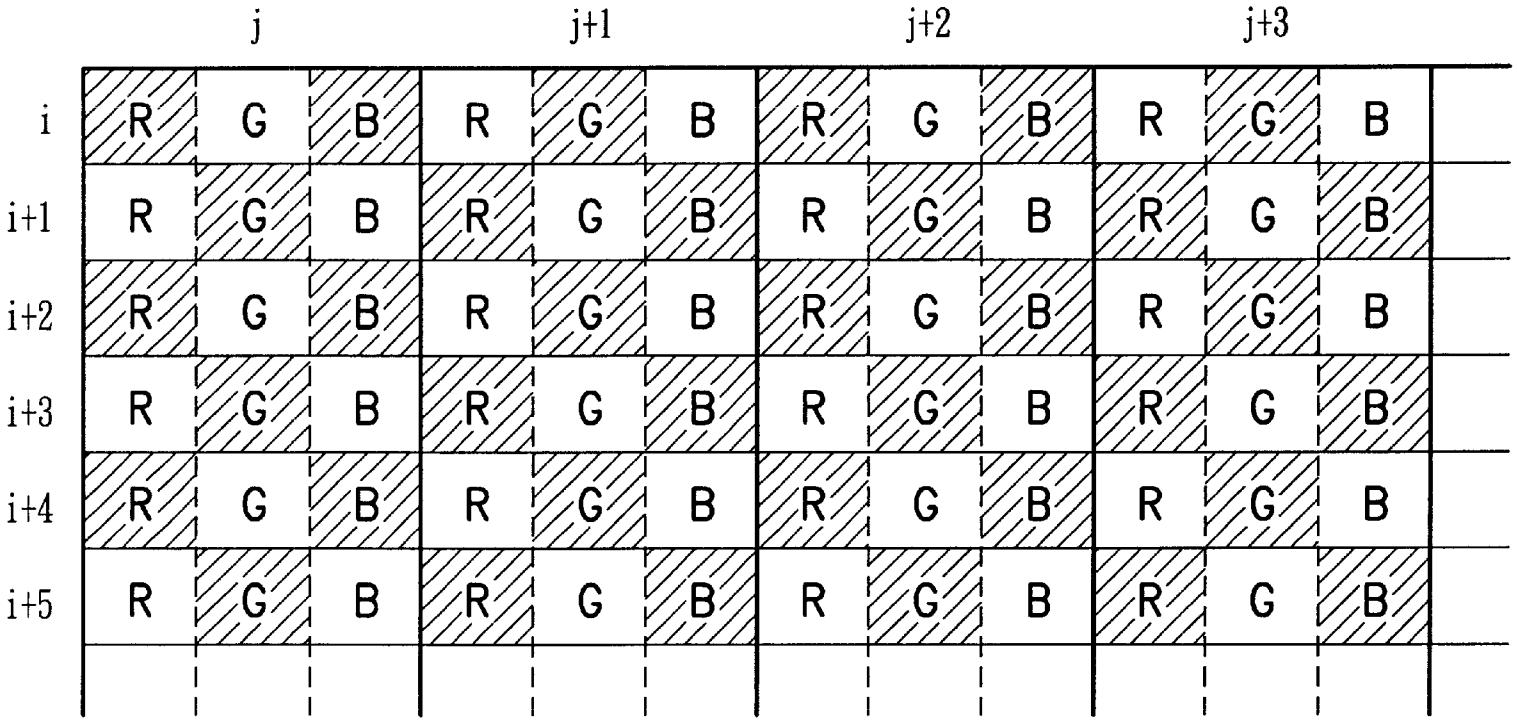
FIG. 2 (PRIOR ART)
FIG. 2 is a schematic diagram of the polarity of the video signal received by display units of a color LCD panel in a prior 1-line dot inversion driving mode.
Figure 3:
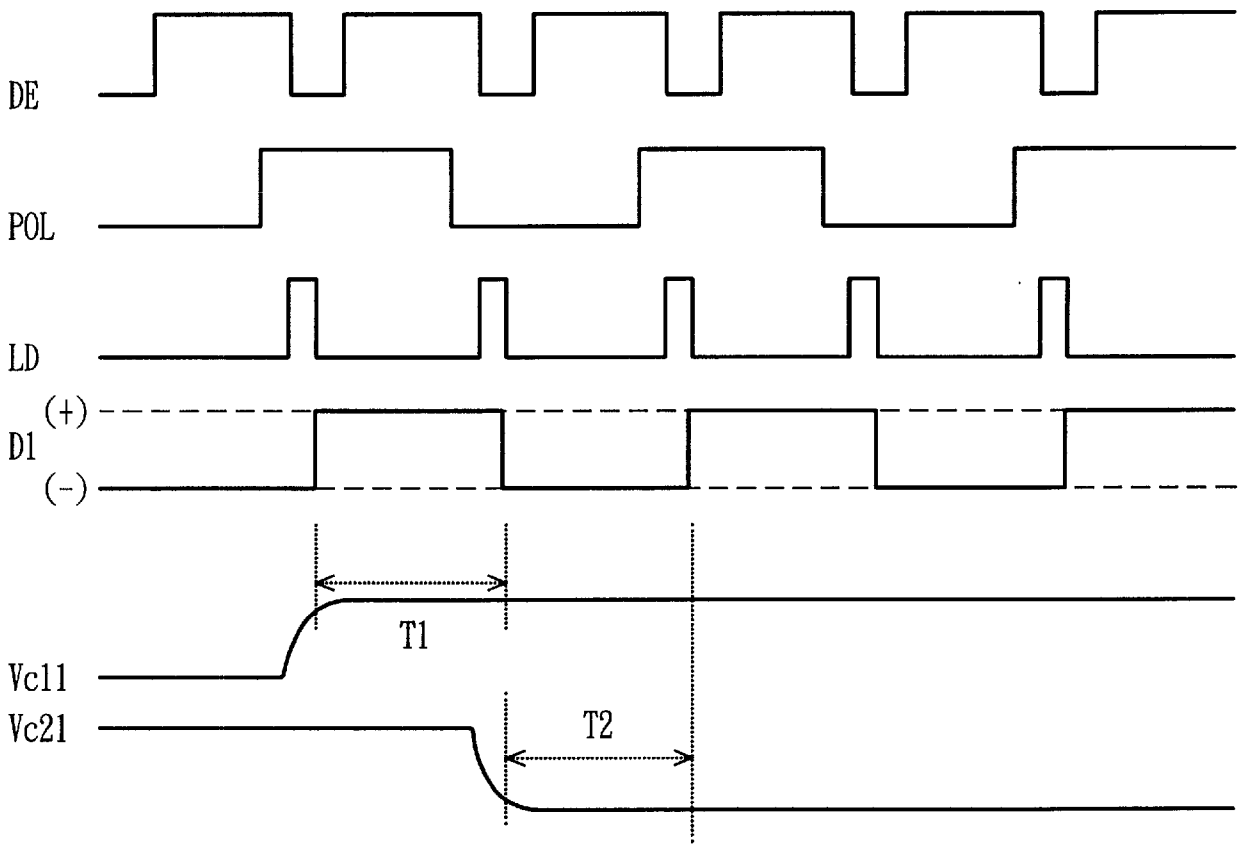
FIG. 3 (PRIOR ART)
FIG. 3 shows a timing diagram of the signals of a color LCD panel and driving circuit thereof in the prior 1-line dot inversion driving mode.
Figure 4:
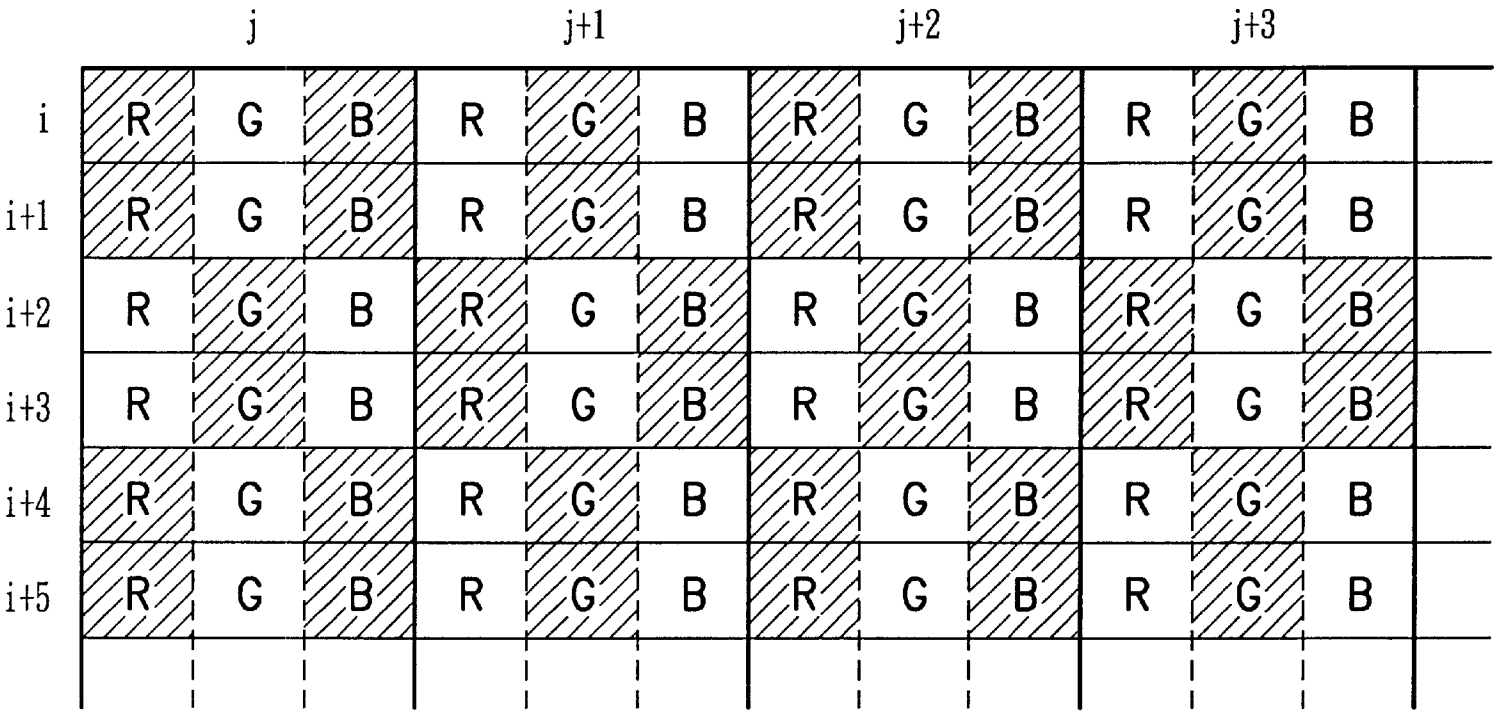
FIG. 4 (PRIOR ART)
FIG. 4 is a schematic diagram of the video signal polarity received from each display unit of a color LCD panel in a prior 2-line dot inversion driving mode.
Figure 5:
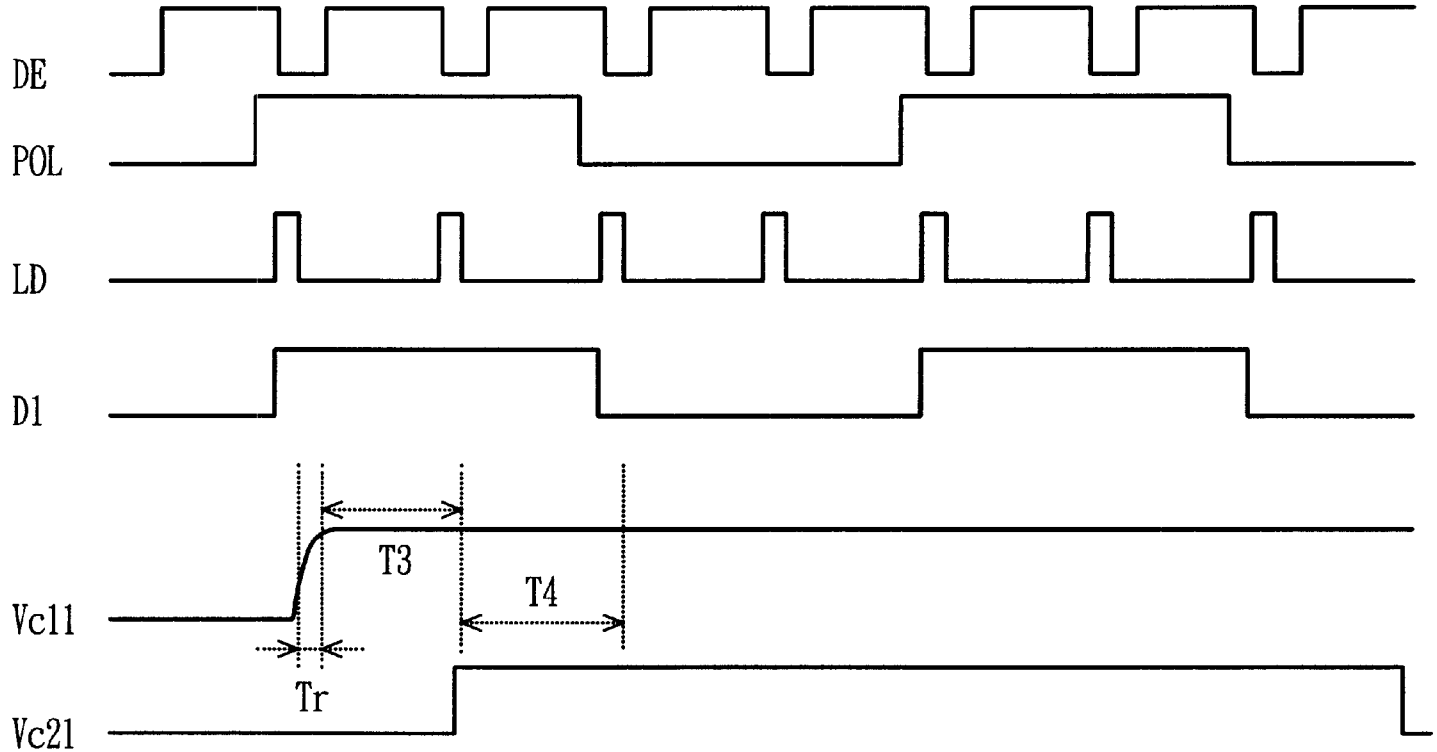
FIG. 5 (PRIOR ART)
FIG. 5 shows the timing diagram of the signals of a color LCD panel and driving circuit thereof in the prior 2-line dot inversion driving mode.

As shown in FIG. 6, the gate driver 10 and the data driver 20 are identical to those of FIG. 1. The added switch circuit 100 receives a first polar control signal POL(1) and a second polar control signal POL(2) from the input terminal, and selects one of the control signals POL(1) and POL(2) in order to input to the polar control pin POL of the data driver 20 according to a selection signal CTRL. The data driver 20 determines whether output a positive or a negative polarity video signal to data electrodes D1–Dm according to the received signal from the polar control pin POL. The first polar control signal POL(1) represents the 1-line dot inversion driving mode, which has a waveform similar to the POL signal of FIG. 3. The second polar control signal POL(2) represents the 2-line dot inversion driving mode, which has a waveform similar to the POL signal of FIG. 5.

In the embodiment, the selection signal CTRL determines the selection of the signal POL(1) or the signal POL(2) according to the LCD panel operating temperature. When the temperature is over a switch temperature, it represents the same brightness between the odd and even scan lines, such that the second polar control signal POL(2) is selected. Otherwise, the first polar control signal POL(1) is selected. Thus, the optimal video polarity driving mode is selected in operation. In addition, according to the measure of a common LCD panel for the charging characteristics when carried out, the switch temperature is ranged between 10° C. to 18° C.

Figure 7:
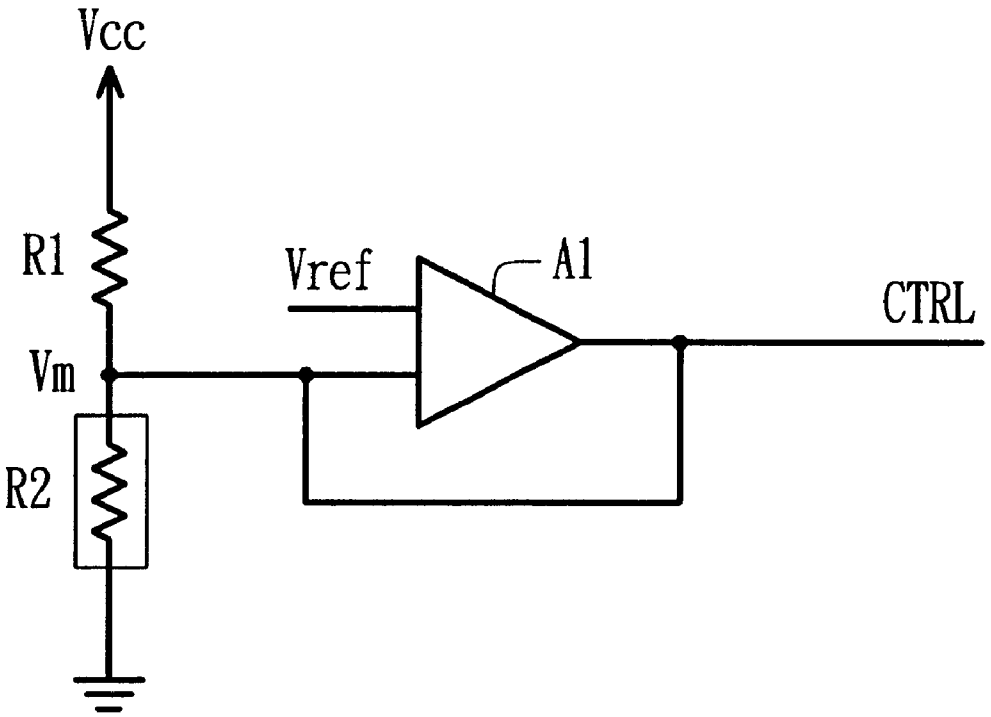
FIG. 7 shows circuitry capable of producing a selection signal of FIG. 6.

Refer to FIG. 7, circuitry capable of producing a selection signal of FIG. 6.

In FIG. 7, the method is carried out by using a general temperature sensor, and the embodiment is an example of a realizable configuration illustration, not a limit to the invention.

As shown in FIG. 7, the basic configuration of the temperature sensor circuit is a comparator circuit including resistances R1, R2, and an operating amplifier A1. Resistance R2 is a resistor having a value depending on the temperature. Resistances R1 and R2 constitute a split voltage circuit, where the intermediate voltage Vm has a value to be changed depending on resistance R2, represented by $Vm=Vcc\times R2/(R1+R2)$. Voltage Vm and a reference voltage Vref are separately inputted into the corresponding positive and negative input terminals of the operating amplifier A1 to compare. The compared result is used to determine the level of the selection signal CTRL. Therefore, the operating temperature of the LCD panel can change the value of the resistance R2 and further determine the level of the selection signal CTRL.

In short, the method of driving the LCD panel is operated by having different polarity control signals with different temperatures, thereby determining a 1-line or a 2-line dot inversion driving mode to be used. When the temperature is higher than the switch temperature, the 2-line dot inversion driving mode is used to avoid the specific frame flickers. Also, in this case no odd and even scan line brightness unevenness shows up. When the temperature is lower than the switch temperature, the 1-line dot inversion driving mode is used to avoid the odd and even scan line brightness unevenness. Also, in this case the flicker level is acceptable. Therefore, the purpose of improving the display frame quality is achieved. Besides, the added elements are minimal in the invention such that the invention is fit to be carried out in factories.

Although the present invention has been described in its preferred embodiment, it is not intended to limit the invention to the precise embodiment disclosed herein. Those who are skilled in this technology can still make various alterations and modifications without departing from the scope and spirit of this invention. Therefore, the scope of the present invention shall be defined and protected by the following claims and their equivalents.

What is claimed is:

1. A LCD panel driving circuit for controlling a LCD panel, the LCD panel having plural display units, which are respectively connected to corresponding plural data electrodes and corresponding plural gate electrodes, the driving circuit comprising:

a gate driver for outputting a scan signal to the gate electrodes;

a data driver for outputting a video signal to the data electrodes, and determining the video signal polarity according to a polar control signal;

a switch circuit, coupled to the data driver, for selecting one of a first polar control signal and a second polar control signal to output according to a selection signal; and a temperature sensor for detecting whether a temperature corresponding to the LCD panel is over a switch temperature and produces the selection signal.

2. The driving circuit of claim 1, wherein the switch temperature ranges between 10° C. to 18° C.

3. The driving circuit of claim 1, wherein the first polar control signal is used to control the video signal as a 1-line dot inversion driving mode and the second polar control signal is used to control the video signal as a 2-line dot inversion driving mode.

4. A LCD, comprising:

a LCD panel, including plural display units, respectively connected to corresponding plural data electrodes and corresponding plural gate electrodes;

a gate driver for outputting a scan signal to the gate electrodes;

a data driver for outputting a video signal to the data electrodes, and determining the video signal polarity according to a polar control signal;

a switch circuit, coupled to the data driver, to select one of a first polar control signal and a second polar control signal to output according to a selection signal; and a temperature sensor for detecting whether a temperature corresponding to the LCD panel is over a switch temperature and produces the selection signal.

5. The LCD of claim 4, wherein the switch temperature ranges between 10° C. to 18° C.

6. The LCD of claim 4, wherein the first polar control signal is used to control the video signal as a 1-line dot inversion driving mode and the second polar control signal is used to control the video signal as a 2-line dot inversion driving mode.

7. A method for improving frame quality of a LCD panel driving circuit, comprising:

detecting whether a temperature corresponding to the LCD panel is over a switch temperature to generate a selection signal; and switching a first polar control signal and a second polar control signal based on the selection signal to eliminate at least one of effects of specific frame flickers and odd and even scan line brightness unevenness.

* * * * *